US007690217B2

(12) United States Patent
Take et al.

(10) Patent No.: US 7,690,217 B2
(45) Date of Patent: Apr. 6, 2010

(54) REFRIGERATION SYSTEM, COMPRESSING AND HEAT-RELEASING APPARATUS AND HEAT-RELEASING DEVICE

(75) Inventors: Koichiro Take, Oyama (JP); Etsuo Shinmura, Oyama (JP); Yuichi Furukawa, Oyama (JP)

(73) Assignee: Showa Denko K.K., Tokyo (JP)

( * ) Notice: Subject to any disclaimer, the term of this patent is extended or adjusted under 35 U.S.C. 154(b) by 1206 days.

(21) Appl. No.: 10/531,705

(22) PCT Filed: Oct. 24, 2003

(86) PCT No.: PCT/JP03/13614

§ 371 (c)(1),
(2), (4) Date: Sep. 29, 2005

(87) PCT Pub. No.: WO2004/038307

PCT Pub. Date: May 6, 2004

(65) Prior Publication Data

US 2006/0137385 A1 Jun. 29, 2006

Related U.S. Application Data

(60) Provisional application No. 60/428,921, filed on Nov. 26, 2002.

(30) Foreign Application Priority Data

Oct. 24, 2002 (JP) ..... 2002-309103

(51) Int. Cl.
*F25B 1/00* (2006.01)

(52) U.S. Cl. ..... 62/498

(58) Field of Classification Search ..... 62/428, 62/498, 507, 510, 87, 401
See application file for complete search history.

(56) References Cited

U.S. PATENT DOCUMENTS 4,531,374 A * 7/1985 Alefeld ..... 62/79

FOREIGN PATENT DOCUMENTS

| | | |
|---|---|---|
| JP | 47-11946 | 5/1972 |
| JP | 51-14358 | 4/1976 |
| JP | 60-4866 | 1/1985 |
| JP | 61-99064 | 5/1986 |
| JP | 61-175862 | 11/1986 |
| JP | 62-196557 | 8/1987 |

(Continued)

*Primary Examiner*—Melvin Jones
(74) *Attorney, Agent, or Firm*—Oblon, Spivak, McClelland, Maier & Neustadt, L.L.P.

(57) ABSTRACT

A refrigeration system including a two-stage type compressor having independent low-pressure and high-pressure compressing portions, a heat-releasing device having independent primary and secondary heat-releasing paths, an expansion valve and a cooler. The refrigerant primarily compressed by the low-pressure compressing portion is primarily released in heat by the primary heat-releasing path. The primarily heat-released refrigerant is secondarily compressed by the high-pressure compressing portion. The secondarily compressed refrigerant is secondarily released in heat by the secondary heat-releasing path to thereby obtain a low-temperature and high-pressure refrigerant. The low-temperature and high-pressure refrigerant is decompressed and expanded by an expansion valve and passes through the cooler to absorb the heat in a room air, and then returns to the low-pressure compressing portion of the compressor. In this system, the refrigerant temperature during the heat-releasing procedure can be kept low.

20 Claims, 6 Drawing Sheets

FOREIGN PATENT DOCUMENTS

| | | |
|---|---|---|
| JP | 63-74970 | 5/1988 |
| JP | 74970/1988 | 5/1988 |
| JP | 4-73599 | 3/1992 |
| JP | 8-226779 | 9/1996 |
| JP | 2000-146326 | 5/2000 |
| JP | 2001-082369 | 3/2001 |
| JP | 2001-099522 | 4/2001 |
| JP | 2001-330387 | 11/2001 |
| JP | 2002-62062 | 2/2002 |
| JP | 2002-106988 | 4/2002 |
| JP | 2002-107044 | 4/2002 |
| WO | 02/064389 | 8/2002 |

* cited by examiner

REFRIGERATION SYSTEM, COMPRESSING AND HEAT-RELEASING APPARATUS AND HEAT-RELEASING DEVICE

CROSS REFERENCE TO RELATED APPLICATIONS

Priority is claimed to Japanese Patent Application No. 2002-309103, filed on Oct. 24, 2002, and U.S. Provisional Application No. 60/428,921, filed on Nov. 26, 2002, the disclosure of which are incorporated by reference in their entireties.

This application is an application filed under 35 U.S.C. §111(a) claiming the benefit pursuant to 35 U.S.C. §119(e)(1) of the filing date of Provisional Application No. 60/428,921 filed on Nov. 26, 2002 pursuant to 35 U.S.C. §111(b).

TECHNICAL FIELD

The present invention relates to a refrigeration system preferably applied to a refrigeration cycle using $CO_2$ refrigerant, and also relates to a compressing and heat-releasing apparatus and a heat-releasing device preferably applied to the refrigeration system.

BACKGROUND ART

The following description sets forth the inventor's knowledge of related art and problems therein and should not be construed as an admission of knowledge in the prior art.

Conventionally, as a refrigerant for use in a vapor compression type refrigeration cycle, Freon series refrigerants were mostly used. In recent years, however, in view of global environmental conservations, as shown in Japanese Unexamined Laid-open Patent Publication No. JP2001-82369 A and Japanese Unexamined Laid-open Patent Publication No. JP2001-99522 A, a refrigeration cycle using a natural refrigerant such as carbon dioxide ($CO_2$) has come to the front.

As a refrigerant system having a $CO_2$ refrigerant refrigeration cycle, for example as shown in FIG. 7, it can be considered that the refrigerant system is provided with a compressor 101, a heat-releasing device (radiator) 102, an intermediate heat exchanger 103, an expansion valve 104, a cooler 105 and an accumulator 106.

The status of the refrigerant in this in-service refrigeration system is illustrated in the Mollier diagram shown in FIG. 8.

As shown in FIGS. 7 and 8, in this refrigeration cycle, the refrigerant is compressed by the compressor 101 to be shifted from the point A to the point B, resulting in a high-temperature and high-pressure gaseous refrigerant. This gaseous refrigerant passes through the heat-releasing device 102 to be cooled by the ambient air to thereby be shifted from the point B to the point C. Subsequently, this refrigerant passes through the intermediate heat exchanger 103 to be sub-cooled by exchanging heat with the return traveling refrigerant, which will be mentioned later, to thereby be shifted from the point C to the point D. Thereafter, the refrigerant is decompressed and expanded by the expansion valve 104 to thereby be shifted to the point D to the point E. Then, this low-temperature and low-pressure refrigerant passes through the cooler 105 to cool the air in a room by absorbing heat from the air. On the other hand, the temperature of the refrigerant itself increases to be shifted from the point E to the point F. Furthermore, the high-temperature and low-pressure refrigerant released from the cooler 105 (i.e., the return traveling refrigerant) is introduced into the accumulator 106 in which only the gaseous refrigerant is extracted. This return traveling refrigerant exchanges heat with the aforementioned forward traveling refrigerant in the intermediate heat exchanger 103 to further increase the temperature to thereby be shifted from the point F to the point A. Then, the refrigerant returns to the compressor 101.

As explained above, in the refrigeration cycle using $CO_2$ as a refrigerant, a supercritical cycle in which the refrigerant pressure exceeds the critical pressure occurs in the high-pressure region in the heat-releasing device 102. Thus, the refrigerant pressure in the high-pressure region becomes higher than that of a refrigeration cycle using Freon series refrigerant, and the refrigerant temperature at the inlet portion of the heat-releasing device becomes higher. Concretely, as shown in the point B in FIG. 8, the refrigerant becomes a high-temperature state exceeding 120° C.

As a result, in cases where an aluminum heat-releasing device with relatively lower heat resistance, which is used in a car air-conditioning refrigeration system, is used as the heat-releasing device 102, there is a possibility that the heat-releasing device components and the like may receive a bad influence by the aforementioned high temperature.

It is an object of the present invention to provide a refrigeration system capable of solving the problems inherent in the aforementioned prior art, keeping the refrigerant temperature lower during the heat-releasing procedure and avoiding harmful effects due to high temperature on a heat-releasing device or the like.

It is another object of the present invention to provide a compressing and heat-releasing apparatus and a heat-releasing device used in the aforementioned refrigeration system.

DISCLOSURE OF INVENTION

In order to attain the aforementioned objects, the present invention has the following structural features.

1. A refrigeration system in which compressing and heat-releasing of a refrigerant by a compressor and a heat-releasing device are performed in turn repeatedly in a multistage manner to obtain a low-temperature and high-pressure refrigerant, wherein the low-temperature and high-pressure refrigerant is decompressed by a decompressing device, then passes through a cooler to absorb heat from a medium to be cooled and then returns to the compressor.

In the invention as recited in Item (1) (first aspect of the invention), since the compressing and heat-releasing of the refrigerant are performed in turn, the refrigerant temperature can be kept low. Accordingly, even if an aluminum device is used as the heat-releasing device, the heat-releasing device never receives a bad influence due to high temperature, which can assuredly prevent defects such as thermal deformation or thermal deterioration of the heat-releasing device. As a result, high reliability and sufficient durability can be secured.

Furthermore, in the first aspect of the invention, since the heat-releasing of the refrigerant is performed stepwise, a predetermined cooling capacity can be obtained.

2. The refrigeration system as recited in Item (1), wherein the refrigerant is carbon dioxide ($CO_2$).

In this system, the refrigerant is limited to $CO_2$ refrigerant.

3. A refrigeration system, comprising:

a primary compressing portion that primarily compresses a refrigerant;

a secondary compressing portion that secondarily compresses the refrigerant;

a primary heat-releasing portion that primarily performs heat-releasing of the refrigerant;

a secondary heat-releasing portion that secondarily performs heat-releasing of the refrigerant;

a decompressing device that decompresses the refrigerant; and a cooling device that cools a medium to be cooled by absorbing heat from the medium, wherein the refrigerant primarily compressed by the primary compressing portion is primarily released in heat by the primary heat-releasing portion, the primarily heat-released refrigerant is secondarily compressed by the secondary compressing portion, the secondarily compressed refrigerant is secondarily released in heat by the secondary heat-releasing portion and then passes through the cooling device to absorb heat from the medium, and then returns to the primary compressing portion.

According to the invention as recited in Item (3) (second aspect of the invention), in the same manner as mentioned above, the heat-releasing device never receives a bad influence due to high temperature, which can assuredly prevent defects such as thermal deformation or thermal deterioration of the heat-releasing device. As a result, high reliability and sufficient durability can be secured.

4. The refrigeration system as recited in Item (3), wherein the refrigeration system is provided with a multistage type compressing device, wherein a first-stage compressing portion of the multistage compressing device constitutes the primary compressing portion, and a second-stage compressing portion of the multistage compressing device constitutes the secondary compressing portion.

In this system, since the multistage type compressing device is used to perform compressing twice, the number of parts in a refrigeration system can be decreased as compared with the case in which two separate compressors are used, resulting in a compact refrigeration system. Thus, the refrigeration apparatus can be decreased in size and weight.

5. The refrigeration system as recited in Item (3), wherein the refrigeration system is provided with a heat-releasing device, wherein a heat-releasing portion of the heat-releasing device is divided into two divisional heat-releasing portions, wherein one of the divisional heat-releasing portions constitutes the primary heat-releasing portion and the other thereof constitutes the secondary heat-releasing portion.

In this system, as compared with the case in which heat-releasing are performed twice by two separate heat-releasing devices, the number of parts can be decreased. Thus, the refrigeration apparatus can be further decreased in size and weight.

6. The refrigeration system as recited in Item (5), wherein a volume rate of the primary heat-releasing portion with respect to an entire volume of the heat-releasing portion of the heat-releasing device is set to be 0.2 to 0.5.

In this system, a bad influence due to high temperature can be assuredly prevented, and therefore higher reliability, sufficient durability and further enhanced cooling capacity can be secured.

7. The refrigeration system as recited in Item (3), wherein a compression ratio of the refrigerant by the secondary compressing portion with respect to a compression ratio of the refrigerant by the primary compressing portion is set to be 0.5 to 1.5.

In this system, the compressing and heat-releasing of the refrigerant can be performed effectively, resulting in further enhanced cooling capacity. In detail, in cases where the compression ratio of the secondary compressing portion with respect to the primary compressing portion is too large (larger than 1.5 times), the refrigerant temperature in the secondary heat-releasing portion becomes high excessively, which causes an extremely low heat-releasing amount in the primary heat-releasing portion, which in turn causes a deterioration of the coefficient of performance. To the contrary, in cases where the compression ratio is too small (less than 0.5 times), the refrigerant temperature in the primary heat-releasing portion becomes high excessively, causing an extremely low heat-releasing amount in the secondary heat-releasing portion, which in turn causes a deterioration of the heat-releasing performance and the cooling capacity.

The compression ratio in the primary compression portion is defined by "CLo/CLi," where the inlet pressure of the refrigerant in the primary compressing portion is "CLi (MPa)" and the outlet pressure of the refrigerant therein is "CLo(MPa)." The compression ratio in the secondary compression portion is defined by "CHo/CHi," where the inlet pressure of the refrigerant in the secondary compressing portion is "CHi(MPa)" and the outlet pressure of the refrigerant therein is "CHo(MPa)." Accordingly, in this system, it is preferable that the compression ratio of the secondary compressing portion with respect to the primary compressing portion "(CHo/CHi)/(CLo/CLi)" is set to be 0.5 to 1.5.

8. The refrigeration system as recited in Item (3), further comprising an intermediate heat exchanger for subcooling the refrigerant secondarily released in heat by the secondary heat-releasing portion by exchanging heat with a return traveling refrigerant flowing out of the cooling device.

In this system, since the refrigerant is subcooled by the intermediate heat exchanger to increase the heat-releasing amount, the cooling capacity can be further enhanced.

9. The refrigeration system as recited in Item (3), wherein carbon dioxide ($CO_2$) is used as the refrigerant.

In this system, the refrigerant is limited to $CO_2$ refrigerant.

The preferable structural features of the second aspect of the invention as recited in Items (4) to (8) can be employed as preferable structural features of the below mentioned third to fifth aspect of the invention.

10. A compressing and heat-releasing apparatus equipped with a multistage compressor, wherein a refrigerant is primarily compressed by a first-stage compressing portion of the multistage compressor, the primarily compressed refrigerant is primarily released in heat by a primary heat-releasing portion, the primarily heat-released refrigerant is secondarily compressed by a second-stage compressing portion of the multistage compressor, the secondarily compressed refrigerant is secondarily released in heat by a secondary heat-releasing portion, to thereby obtain a low-temperature and high-pressure refrigerant.

This invention as recited in Item (10) (third aspect of the invention) specifies the compressing and heat-releasing device to be preferably applied to the first and second aspect of the present invention. By employing this apparatus, the aforementioned functions and effects can be assuredly obtained.

In the third aspect of the invention, in the same manner as mentioned above, it is preferable to employ the following structural features (11) to (14).

11. The compressing and heat-releasing apparatus as recited in Item (10), wherein the compressing and heat-releasing apparatus is provided with a heat-releasing device, wherein a heat-releasing portion of the heat-releasing device is divided into two divisional heat-releasing portions, wherein one of the divisional heat-releasing portions constitutes the primary heat-releasing portion and the other thereof constitutes the secondary heat-releasing portion.

12. The compressing and heat-releasing apparatus as recited in Item (11), wherein a volume rate of the primary heat-releasing portion with respect to an entire volume of the heat-releasing portion of the heat-releasing device is set to be 0.2 to 0.5.

13. The compressing and heat-releasing apparatus as recited in any one of Items (10) to (12), wherein a compression ratio of the refrigerant by the secondary compressing portion with respect to a compression ratio of the refrigerant by the primary compressing portion is set to be 0.5 to 1.5.

14. The compressing and heat-releasing apparatus as recited in Item (10), wherein carbon dioxide ($CO_2$) is used as the refrigerant.

15. A heat-releasing device provided with a primary heat-releasing portion for primarily releasing heat of a primarily compressed refrigerant and a secondary heat-releasing portion for secondarily releasing heat of a secondarily compressed refrigerant after being primarily released in heat, the heat-releasing device comprising:

a pair of headers; and a plurality of heat exchanging tubes disposed between the pair of headers arranged in parallel with each other in a longitudinal direction of the header with opposite ends thereof being connected to the headers;

wherein a refrigerant passing through the plurality of heat exchanging tubes exchanges heat with cooling air introduced from a front side of the heat-releasing device and passing through a gap between adjacent heat exchanging tubes to be released in heat, wherein each of the headers is divided by a partitioning member at a same height position to thereby classify the plurality of heat exchanging tubes into upper and lower heat exchanging tube groups, one of the heat exchanging tube group constituting the primary heat-releasing portion and the other thereof constituting the secondary heat-releasing portion.

This invention as recited in Item (15) (fourth aspect of the invention) specifies the heat-releasing device to be preferably applied to any one of the first to third aspect of the present invention. By employing this apparatus, the aforementioned functions and effects can be assuredly obtained.

16. The heat-releasing device as recited in Item (15), wherein the lower heat exchanging tube group constitutes the primary heat-releasing portion and the upper heat exchanging tube group constitutes the secondary heat-releasing portion.

In this heat-releasing device, the heat exchanging efficiency can be further enhanced. That is, in cases where this invention is applied to a heat-releasing device in a car air-conditioner, the lower side of the cooling air to be introduced into the heat-releasing device is higher in temperature than the upper side thereof because of various factors such as heat radiation from the ground. Accordingly, by introducing the lower air of higher temperature into the primary heat-releasing path at the higher temperature side and the upper air of lower temperature into the secondary heat-releasing path at the lower temperature side, sufficient temperature difference between the refrigerant and the cooling air can be secured in both the primary and secondary heat-releasing paths. This enables efficient heat exchanging, resulting in efficient refrigerant heat-releasing.

In the fourth aspect of the invention, it is preferable to employ the following structural features (17) and (18).

17. The heat-releasing device as recited in Item (15), wherein an inner volume rate of the heat exchanging tubes constituting the primary heat-releasing portion with respect to an entire inner volume of the plurality of heat exchanging tubes is set to be 0.2 to 0.5.

18. The heat-releasing device as recited in Item (15), wherein carbon dioxide ($CO_2$) is used as the refrigerant.

19. A heat-releasing device provided with a primary heat-releasing portion for primarily releasing heat of a primarily compressed refrigerant and a secondary heat-releasing portion for secondary releasing heat of a secondary compressed refrigerant after being primarily released in heat, the heat-releasing device comprising:

a pair of headers; and a plurality of heat exchanging tubes disposed between the pair of headers arranged in parallel with each other in a longitudinal direction of the header with opposite ends thereof being connected to the headers;

wherein a refrigerant passing through the plurality of heat exchanging tubes exchanges heat with cooling air introduced from a front side of the heat-releasing device and passing through a gap between adjacent heat exchanging tubes to be released in heat, wherein each of the heat exchanging tubes is provided with a plurality of refrigerant passages arranged in a tube widthwise direction, wherein each of the pair of headers is divided by a partitioning member extending in a longitudinal direction of the header into a front space and a rear space, whereby the plurality of refrigerant passages of each heat exchanging tube is classified into a front refrigerant passage group and a rear refrigerant passage group, one of the refrigerant passage groups constituting the primary heat-releasing portion and the other thereof constituting the secondary heat-releasing portion.

This invention as recited in Item (19) (fifth aspect of the invention) specifies the heat-releasing device to be preferably applied to any one of the first to third aspect of the present invention. By employing this apparatus, the aforementioned functions and effects can be assuredly obtained.

20. The heat-releasing device as recited in Item (19), wherein the rear refrigerant passage group constitutes the primary heat-releasing portion and the front refrigerant passage group constitutes the secondary heat-releasing portion.

In this heat-releasing device, the heat exchanging efficiency can be further enhanced. That is, the lower-temperature cooling air which has not yet been passed through any heat-releasing portion is introduced to the lower-temperature side secondary heat-releasing portion, and the higher-temperature cooling air which has been passed through the secondary heat-releasing means is introduced to the higher-temperature side primary heat-releasing portion, to thereby releasing heat, respectively. Thus, in any of the primary and secondary heat-releasing means, sufficient temperature difference between the refrigerant and the cooling air can be secured, resulting in efficient heat exchanging, which enables more efficient heat-releasing of the refrigerant.

In the fifth aspect of the invention, in the same manner as mentioned above, it is preferable to employ the following structural features (21) and (22).

21. The heat-releasing device as recited in Item (19), wherein an inner volume rate of the heat exchanging tubes constituting the primary heat-releasing portion with respect to an entire inner volume of the plurality of heat exchanging tubes is set to be 0.2 to 0.5.

22. The heat-releasing device as recited in Item (19), wherein carbon dioxide ($CO_2$) is used as the refrigerant.

In the refrigeration system of the first and second aspect of the invention, a bad influence due to high temperature will never be received. Thus, high reliability and sufficient durability can be assured. Furthermore, sufficient refrigerant heat-releasing amount can be secured, resulting in an enhanced cooling capacity.

The third to fifth aspect of the invention specifies the compressing and heat-releasing device or the heat-releasing device to be preferably applied to the first and second aspect of the present invention. Therefore, the similar effects in the aforementioned first and second aspect of the invention can be assuredly obtained.

Other objects and the features will be apparent from the following detailed description of the present invention with reference to the attached drawings.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspects or features of other embodiments where applicable. The descriptions of aspects, features and/or advantages of particular embodiments should not be construed as limiting other embodiments or the claims.

BEST MODE FOR CARRYING OUT THE INVENTION

The present invention will be described in detail with reference to the attached drawings.

Figure 1:
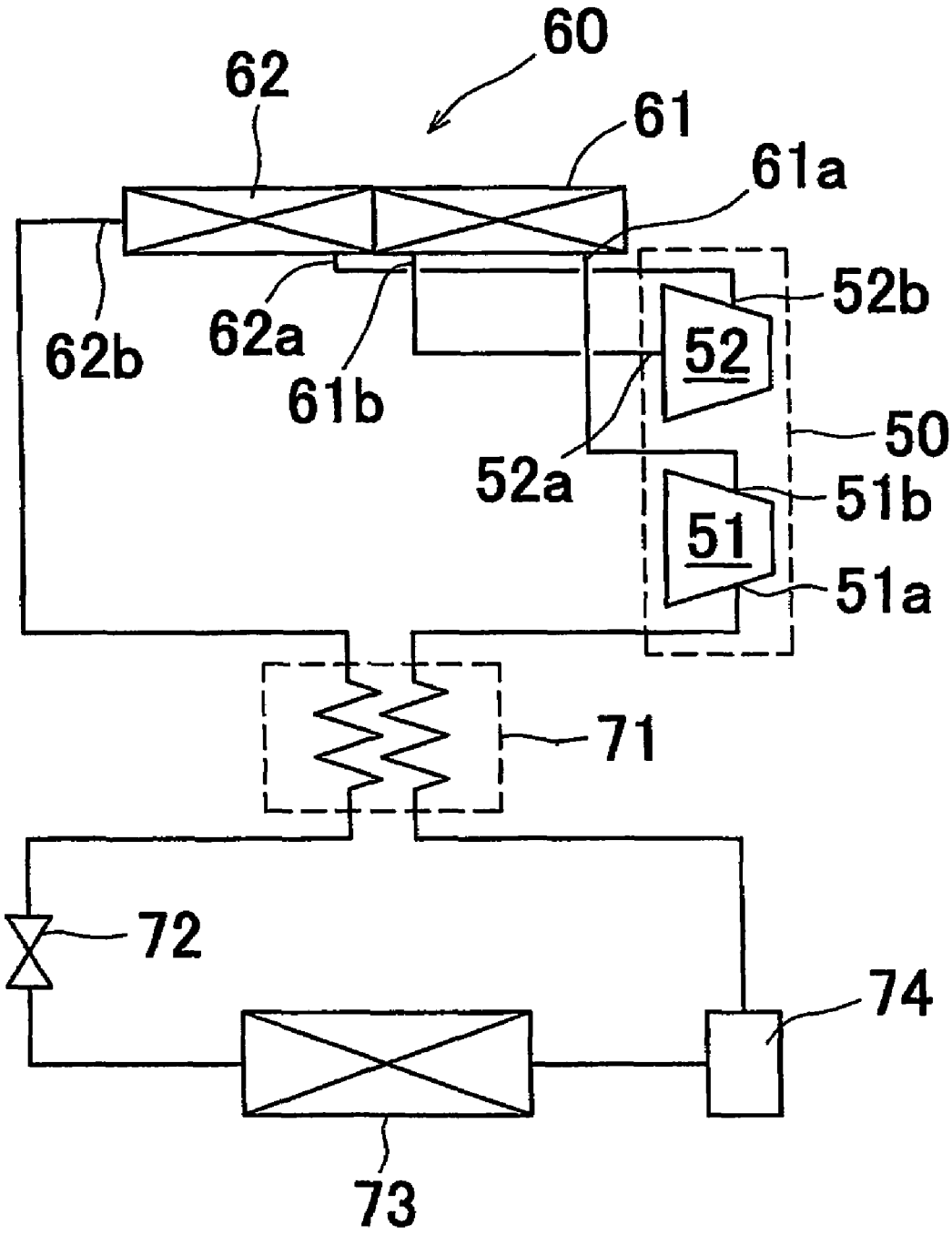
FIG. 1 is a refrigerant circuit diagram of a refrigerant system according to an embodiment of the present invention.

FIG. 1 is a refrigerant circuit diagram of a refrigeration cycle in a refrigeration system according to an embodiment of the present invention. As shown in FIG. 1, the refrigeration system of this embodiment is provided with a multistage compressor 50, a heat-releasing device 60 as a gas cooler, an intermediate heat exchanger 71, an expansion valve 72 as a decompressing device, a cooler 73 such as an evaporator, and an accumulator 74, as fundamental structural elements.

The compressor 50 is a two-stage type device provided with a low-pressure compressing portion 51 as an initial compressing means and a high-pressure compressing portion 52 as a secondary compressing means. Both compressing portions 51 and 52 are constructed independently, and are provided with refrigerant inlets 51*a* and 52*a* and refrigerant outlets 51*b* and 52*b*, respectively. The low-pressure compressing portion 51 compresses the refrigerant introduced via the refrigerant inlet 51*a* at a low-pressure area and then lets out the compressed refrigerant via the refrigerant outlet 51*b*. On the other hand, the high-pressure compressing portion 52 compresses the refrigerant introduced via the refrigerant inlet 52*a* at a high-pressure area and then lets out the compressed refrigerant via the refrigerant outlet 52*b*.

Figure 2:
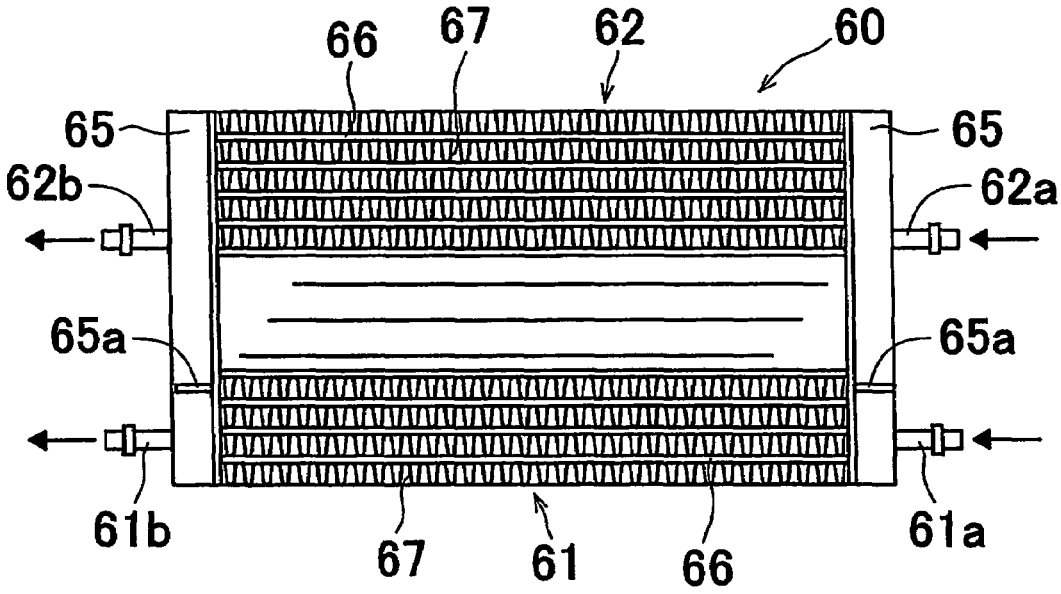
FIG. 2 is a front view showing a heat-releasing device applied to the refrigerant system of the embodiment.

As shown in FIG. 2, the heat-releasing device 60 is a header-type heat exchanger and is provided with a pair of pipe-shaped header tanks 65 and 65 disposed in parallel with each other at a certain distance, a plurality of flat heat exchanging tubes 66 disposed in parallel with each other along the longitudinal direction (up-and-down direction) of the header tanks 65 with the opposite ends in fluid communication with the header tanks 65 and 65, and corrugated fins 67 disposed between the adjacent heat exchanging tubes 66.

The heat exchanging tube 66 has a plurality of refrigerant passages disposed in parallel in the widthwise direction (fore and aft direction), so that refrigerant can passes through each refrigerant passage. Both of the header tanks 65 and 65 are provided with partitioning members 65*a* and 65*a* at the same longitudinal position (at the same height), whereby the inside space of each header tank 65 is divided into an upper space and a lower space. Thus, the plurality of heat exchanging tubes 66 are classified into an upper group and a lower group. The lower heat exchanging tube group located below the partitioning member 65*a* forms a primary heat-releasing path 61 as an initial heat-releasing means, and the upper heat exchanging tube group located above the partitioning member 65*a* forms a secondary heat-releasing path 62 as a secondary heat-releasing means.

One of the header tanks 65 is provided with refrigerant inlets 61*a* and 62*a* corresponding to the primary and secondary heat-releasing paths 61 and 62, and the other header tank 65 is provided with refrigerant outlets 61*b* and 62*b* corresponding to the primary and secondary heat-releasing paths 61 and 62.

In this heat-releasing device 60, the refrigerant introduced via the inlets 61*a* and 62*a* passes through heat exchanging tubes 66 corresponding to the primary and secondary heat-releasing paths 61 and 62. On the other hand, cooling air introduced from the front side of the heat-releasing device passes through the gaps between adjacent heat exchanging tubes 66. Thus, the refrigerant exchanges heat with the cooling air while passing through each heat exchanging tube 66 to be cooled (to radiate the heat) and flows out of the outlets 61*b* and 62*b*.

In this embodiment, each component constituting the heat-releasing device 60 is made of, for example, aluminum or its alloy, or an aluminum brazing sheet in which brazing material is laminated at least one surface thereof. These components are provisionally assembled into a certain heat exchanger configuration via brazing materials and temporarily fixed. This provisionally assembled and temporarily fixed components are brazed in a furnace at the same time, thereby integrally connecting the entire components.

The intermediate heat exchanger 71 exchanges heat between the forward traveling refrigerant and the return traveling refrigerant to subcool the forward traveling refrigerant.

The expansion valve 72 decompresses and expands the refrigerant, and the cooler 73 cools the room air (a medium to be cooled) by exchanging the heat of the decompressed and expanded refrigerant with the heat of the room air.

Furthermore, the accumulator 74 separates the refrigerant into a liquefied refrigerant and a gaseous refrigerant to extract only the gaseous refrigerant.

In the refrigeration system of this embodiment, the outlet 51*b* of the low-pressure compressing portion 51 of the compressor 50 is connected to the inlet 61*a* of the primary heat-releasing path 61 of the heat-releasing device 60, and the outlet 61*b* of the primary heat-releasing path 61 is connected to the inlet 52*a* of the high-pressure compressing portion 52 of the compressor 50.

Furthermore, the outlet 52*b* of the high-pressure compressing portion 52 is connected to the inlet 62*a* of the secondary heat-releasing path 62 of the heat-releasing device 60 and the outlet 62*b* of the secondary heat-releasing path 62 is connected to the forward traveling refrigerant inlet of the intermediate heat exchanger 71.

The forward traveling refrigerant outlet of the intermediate heat exchanger 71 is connected to the inlet side of the expansion valve 72, and the outlet side of the expansion valve 72 is connected to the inlet of the cooler 73.

Furthermore, the outlet of the cooler 73 is connected to the inlet of the accumulator 74, and the outlet of the accumulator 74 is connected to the return traveling refrigerant inlet of the intermediate heat exchanger 71.

The return traveling refrigerant outlet of the intermediate heat exchanger 71 is connected to the inlet 51*a* of the low-pressure compressing portion 51 of the compressor 50.

This refrigeration system uses $CO_2$ as a refrigerant, and can be preferably mounted in a vehicle as an automobile air-conditioning apparatus or the like.

Figure 3:
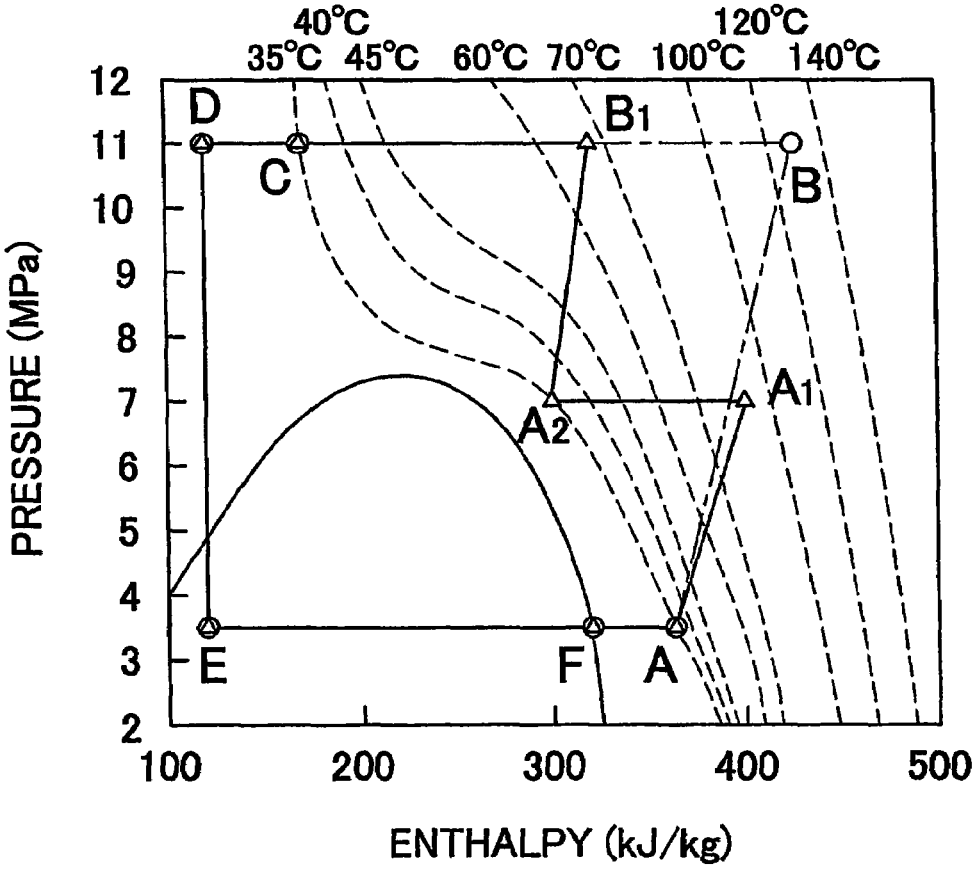
FIG. 3 is a Mollier diagram showing the refrigerant status in the refrigeration system of the embodiment.

In this refrigerant system, as shown in FIG. 3, the refrigerant is compressed (primarily compressed) by the low-pressure compressing portion 51 of the compressor 50 to thereby be shifted from the point A to the point A1.

Subsequently, the primarily compressed refrigerant passes through the primary heat-releasing path 61 of the hear releasing device 60 to be cooled (primarily hear-released) by exchanging heat with the ambient air (the air to be cooled) to thereby be shifted from the point A1 to the point A2.

The primarily heat-released refrigerant is compressed (secondarily compressed) to the high-pressure state by the high-pressure compressing portion 52 of the compressor 50 to thereby be shifted from the point A2 to the point B1.

The secondarily compressed refrigerant passes through the secondary heat-releasing path 62 of the hear releasing device 60 to be cooled (secondarily heat-released) by exchanging the heat with the ambient air to thereby be shifted from the point B1 to the point C.

Subsequently, the secondarily heat-released refrigerant (forward traveling refrigerant) passes through the intermediate heat exchanger 71 to be subcooled by exchanging the heat with the below-mentioned return traveling refrigerant to thereby be shifted from the point C to the point D.

Further, the subcooled refrigerant is decompressed and expanded by the expansion valve 72 to thereby be shifted from the point D to the point E.

Then, this low-temperature and low-pressure refrigerant is introduced into the cooler 73 to cool the room air by absorbing the heat from the room air (a medium to be cooled). The refrigerant itself is heated therein to be shifted from the point E to the point F.

The enthalpy difference between the point E and the point F corresponds to the cooling heat quantity and defines the refrigeration capacity.

The high-temperature and low-pressure refrigerant heated in the cooler 73 (return traveling refrigerant) is introduced into the accumulator 74, and only the gaseous refrigerant is extracted.

The return traveling refrigerant flowing out of the accumulator 74 passes through the intermediate heat exchanger 71 to be heated by exchanging the heat with the aforementioned forward traveling refrigerant to thereby be shifted from the point F to the point A, and then returns to the low-pressure compressing portion 51 of the compressor 50.

In the refrigeration system of this embodiment, since the compression of the refrigerant and the heat release thereof are performed in turn, as shown in the point A1 in FIG. 3, the inlet temperature (maximum temperature) of the refrigerant at the inlet side of the primary heat-releasing path 61 can be kept at a lower temperature of 120° C. or below. Accordingly, the aluminum component materials of the primary heat-releasing device 60 never receive a bad influence due to high temperature, which assuredly can prevent defects such as thermal deformation or thermal deterioration of the heat-releasing device component materials. This causes high reliability and enough durability.

Furthermore, since the refrigerant heat-releasing is performed stepwise in the primary heat-releasing path 61 and then in the secondary heat-releasing path 62, the predetermined heat-releasing amount can be assuredly secured, causing sufficient enthalpy difference within the cooler 73, which in turn can attain high refrigeration capacity.

Furthermore, in the refrigeration system of this embodiment, since the heat-releasing is performed stepwise during the compression procedures, the refrigerant status in the primary compression procedure and that in the secondary compression procedure become near the isothermal curve, i.e., the isothermal compression status. Therefore, the workload at the time of compressing decreases, resulting in enhanced coefficient of performance.

Furthermore, in the refrigeration system of this embodiment, since the refrigerant is heat-released by the heat-releasing device 60, and then subcooled (heat-released) by the intermediate heat exchanger 71 to thereby increase the heat release amount, the refrigeration performance can be further improved.

Furthermore, in the refrigeration system of this embodiment, since the primary and secondary heat-releasing portions 61 and 62 are formed by separating a single heat-releasing device 60 which is the so-called header type heat exchanger, the number of parts can be decreased as compared with the case in which heat-releasing is performed twice by two separate heat-releasing devices, resulting in a refrigeration apparatus with decreased size and weight.

Furthermore, in the refrigeration system of this embodiment, since the multistage (two-stage) compressor 50 having two compressing portions 51 and 52 is employed to perform the double compressing, the number of parts can be decreased as compared with the case in which two separate compressors are employed, resulting in a refrigeration apparatus with further decreased size and weight.

Furthermore, in this embodiment, since the primary heat-releasing path 61 at the higher temperature side of the heat-releasing device 60 is located at the lower side of the secondary heat-releasing path 62 at the lower temperature side of the heat-releasing device 60, the heat exchanging efficiency can be further improved because of the following reasons. In cases where this refrigeration cycle is applied to, for example, a car air-conditioner, the lower side of the cooling air to be introduced into the heat-releasing device 60 is higher in temperature than the upper side thereof because of various factors such as heat radiation from the ground. Accordingly, by introducing the lower air of higher temperature into the primary heat-releasing path 61 at the higher temperature side and the upper air of lower temperature into the secondary heat-releasing path 62 at the lower temperature side, sufficient temperature difference between the refrigerant and the cooling air can be secured in both the primary and secondary heat-releasing paths 61 and 62. This enables efficient heat exchanging, resulting in efficient refrigerant heat-releasing.

In this embodiment, it is preferable that the capacity rate of the primary heat-releasing path 61 (the total cross-sectional area of the heat exchanging tubes of the primary path) is set to be 20 to 50% of the entire capacity of the heat-releasing portions of the heat-releasing device 60, i.e., the total capacity of the primary and secondary heat-releasing paths 61 and 62 (the total cross-sectional area of the entire heat exchanging tubes). More preferably, the upper limit is set to be 30% or less.

If the capacity rate is too small, it becomes difficult to obtain enough refrigeration effect because the coefficient of performance (cooling capacity/compressing power) deteriorates, or the refrigerant temperature at the inlet 62*a* of the secondary heat-releasing path 62 becomes extremely high. To the contrary, if the capacity ratio becomes too large, the coefficient of performance deteriorates, which make it difficult to obtain enough refrigeration effect.

In the aforementioned heat-releasing device 60, the device 60 is divided in the vertical direction (up-and-down direction) with respect to the cooling air introduction direction to have the primary heat-releasing means 61 at the lower side and the secondary heat-releasing means 62 at the upper side. In place of the above, in the present invention, the primary heat-releasing means can be provided at the upper side and the secondary heat-releasing means can be provided at the lower side.

Furthermore, in the present invention, as a heat-releasing means, the so-called multi-flow type heat-releasing means having refrigerant passages formed into a U-turn or zigzag shape in a plane perpendicular to the cooling air introducing direction can be employed.

Furthermore, in the present invention, the heat-releasing device can be divided in the cooling air introducing direction to form a primary heat-releasing path and a secondary heat-releasing path (primary and secondary heat-releasing means).

For example, the following structure can be employed. The inside space of each of the header tanks 65 and 65 is divided into a frontward space and a rearward space by providing a partitioning plate within each header tank 65 along the longitudinal direction of the header tank so that a plurality of refrigerant passages in each heat exchanging tube 66 connected thereto are classified into frontward refrigerant passages and rearward refrigerant passages, one of them constituting a primary heat-releasing path (primary heat-releasing means) and the other constituting a secondary heat-releasing path (secondary heat-releasing means).

In this case, it is preferable that the frontward side of the tube constituting the upstream side refrigerant passages with respect to the cooling air introducing direction is the secondary heat-releasing path (secondary heat-releasing means) and the rearward side of the tube constituting the downstream side refrigerant passages with respect to the cooling air introducing direction is the primary heat-releasing path (primary heat-releasing means). That is, the lower-temperature cooling air which has not yet been passed through any heat-releasing portion is introduced to the lower-temperature side secondary heat-releasing means, and the higher-temperature cooling air which has been passed through the secondary heat-releasing means is introduced to the higher-temperature side primary heat-releasing means, thereby releasing heat, respectively. Thus, in any of the primary and secondary heat-releasing means, sufficient temperature difference between the refrigerant and the cooling air can be secured, resulting in efficient heat exchanging, which enables more efficient heat-releasing of the refrigerant.

Furthermore, in the present invention, primary and secondary heat-releasing means disposed fore and aft can be formed into the aforementioned multi-flow type heat-releasing means.

Furthermore, in the present invention, primary and secondary heat-releasing means disposed above and below can be divided in the cooling air introducing direction (fore and aft direction), respectively, so that each heat-releasing means can be the so-called counter-flow type having refrigerant passages fore and aft.

Furthermore, in the present invention, the installation direction of the heat-releasing device is not limited to a specific one. For example, the heat-releasing device can be installed such that the headers are disposed vertically, horizontally or obliquely.

Furthermore, in the aforementioned embodiment, although the intermediate heat exchanger 71 is disposed at the downstream side of the heat-releasing device 60, in the present invention, it is not always necessary to employ this intermediate heat exchanger 71.

Furthermore, in the aforementioned embodiment, although a two-stage compressing (heat-releasing) type refrigeration system is exemplified, the present invention is not limited to it, and can be applied to a multi-stage (three-stage or more) compressing and heat-releasing type refrigeration system.

Example 1

In the refrigeration system shown in FIG. 1, the relationship between the temperature effectiveness of the hear releasing device 60 and the cooling capacity thereof (kw) and the relationship between the temperature effectiveness of the heat-releasing device 60 and the coefficient of performance thereof (cooling capacity/compressing power) were obtained by computer simulations, respectively.

Comparative Example

Figure 7:
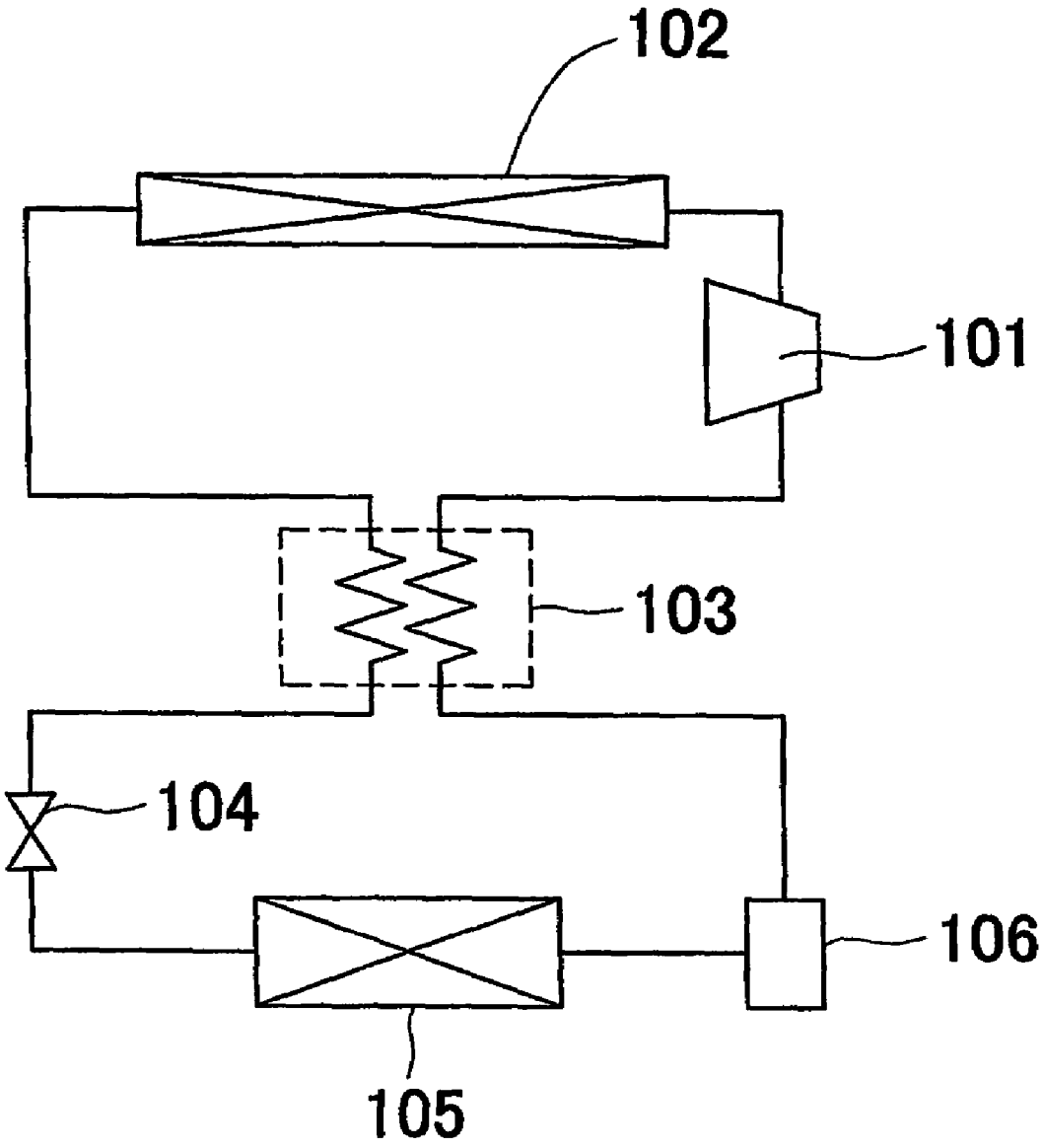
FIG. 7 is a refrigerant circuit diagram of a refrigerant system as a background technique.
Figure 8:
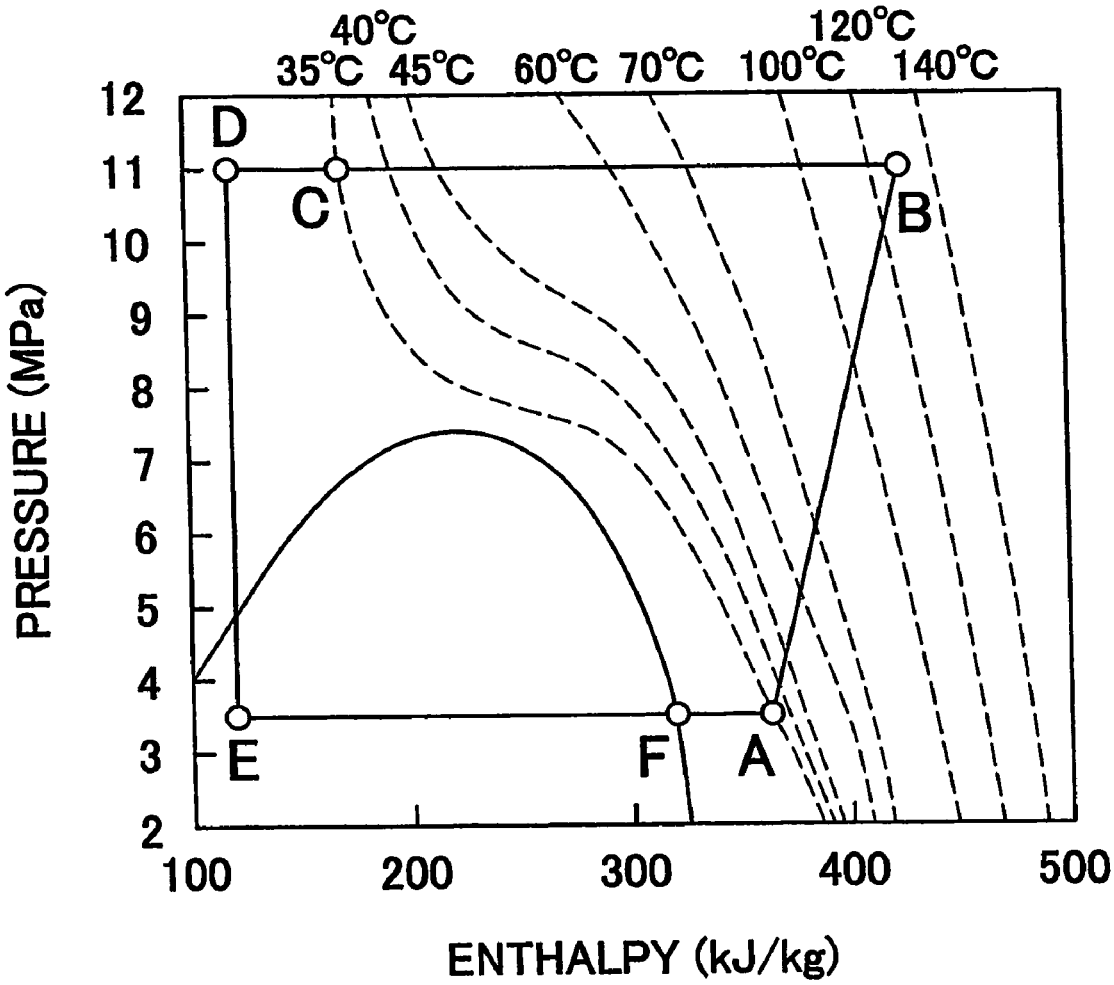
FIG. 8 is a Mollier diagram showing the refrigerant status in the refrigeration system as the background technique.

In the conventional refrigeration system shown in FIG. 7, the relationship between the temperature effectiveness of the hear releasing device 102 and the cooling capacity thereof (kw) and the relationship between the temperature effectiveness of the heat-releasing device 120 and the coefficient of performance thereof were obtained by computer simulations, respectively.

Figure 4:
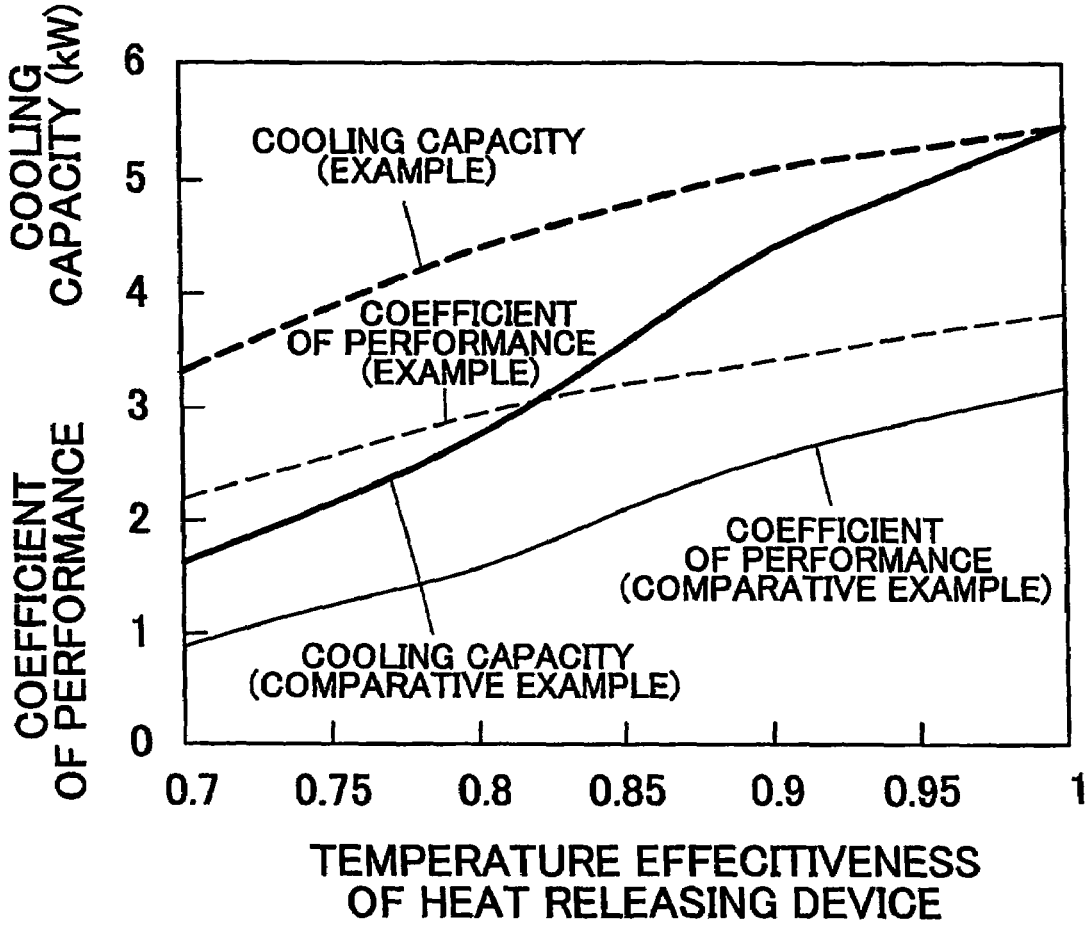
FIG. 4 is a graph showing the relationship between the temperature effectiveness and the cooling capacity/the coefficient of performance in refrigeration systems of the embodiment and a comparative embodiment.

The results of the aforementioned Example 1 and Comparative Example are shown in the graph of FIG. 4.

As will be apparent from the graph, the refrigerant system of Example 1 related to the present invention is superior in both cooling capacity and coefficient of performance to the refrigerant system of the Comparative Example.

Especially, in the two-stage compressing cycle of Example 1, as mentioned above, since the compressing procedure can be performed by the isothermal compression, the workload at the time of compression can be decreased, which in turn can increase the coefficient of performance.

To the contrary, in the cycle of Comparative Example, the temperature increase at the time of compression procedure is large, resulting in increased workload at the time of compression, which in turn cause a deterioration of the coefficient of performance.

Furthermore, in the cycle of Example 1, even in cases where the temperature effectiveness of the heat-releasing device is low (for example, even in cases where it is difficult to secure a sufficient size of the heat-releasing device), since the inlet side temperature at the secondary compressing procedure (i.e., the inlet temperature of the high-pressure compressing portion) is low, the outlet temperature can be decreased sufficiently, resulting in sufficient cooling capacity.

To the contrary, in the cycle of Comparative Example, in cases where it is difficult to secure a sufficient size of the heat-releasing device, the outlet side temperature at the compressing procedure (i.e., the outlet temperature of the compressing device) cannot be decreased, resulting in insufficient cooling capacity.

Example 2

In the refrigeration system shown in FIG. 1, the relationship between the volume rate of the primary heat-releasing portion 61 with respect to the entire volume of the heat-releasing portions of the heat-releasing device 60 and the coefficient of performance was obtained by computer simulations.

Figure 5:
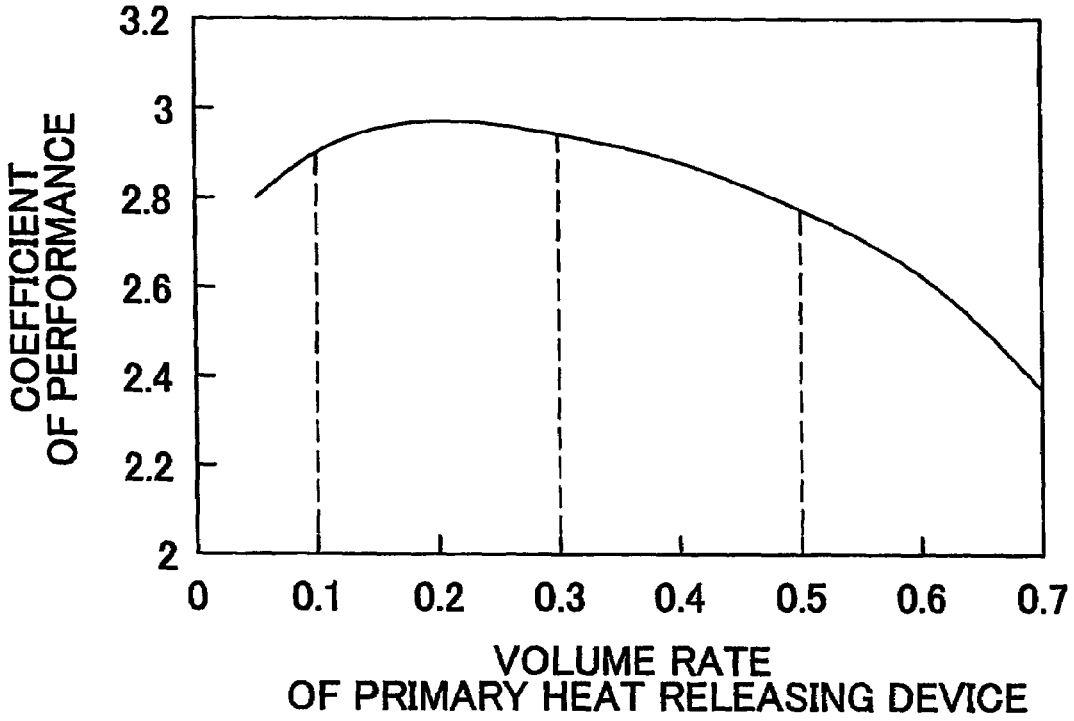
FIG. 5 is a graph showing the relationship between the volume rate of the primary heat-releasing device and the coefficient of performance in the refrigeration system of the embodiment.

The results are shown in the graph of FIG. 5.

As will be apparent from the graph, excellent coefficient of performance can be obtained when the volume rate of the primary heat-releasing portion 61 falls within the rage of 0.1 to 0.5, especially 0.3 or less.

Example 3

In the refrigeration system shown in FIG. 1, the relationship between the volume rate of the primary heat-releasing portion 61 with respect to the entire volume of the heat-releasing portions of the heat-releasing device 60 and the inlet temperature of the secondary heat-releasing portion 62 was obtained by computer simulations.

Figure 6:
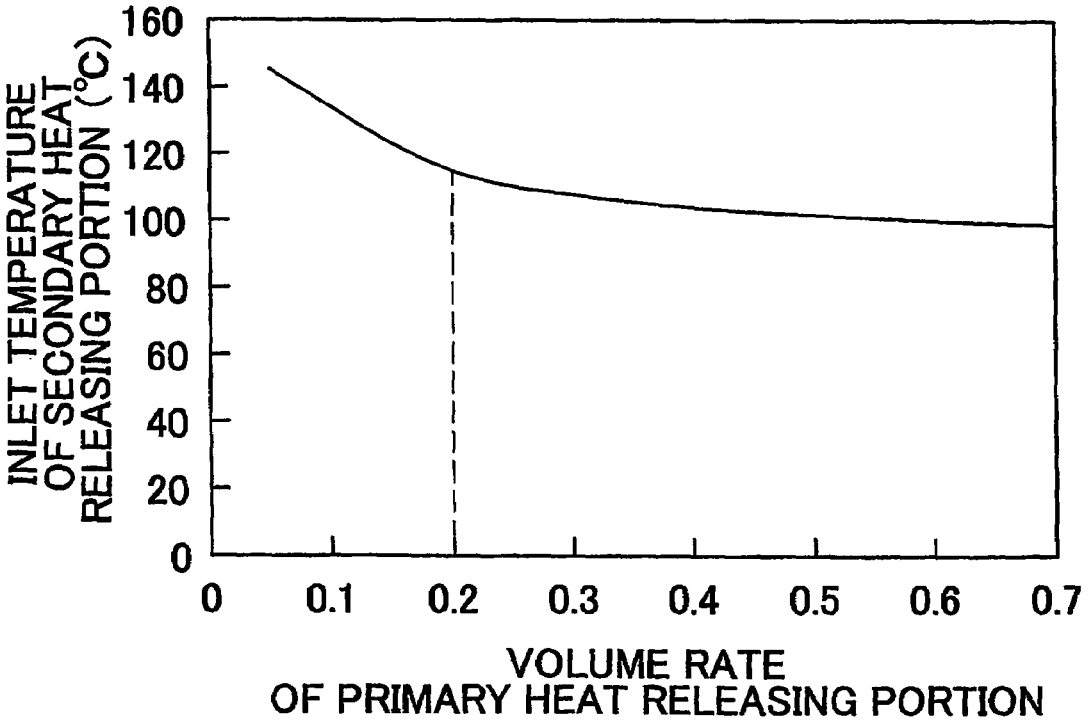
FIG. 6 is a graph showing the relationship between the volume ratio of the primary heat-releasing device and the inlet refrigerant temperature of the secondary heat-releasing device in the refrigeration system of the embodiment.

The results are shown in the graph of FIG. 6.

As will be apparent from the graph, the inlet temperature of the secondary heat-releasing portion 62 was low in the area in which the volume rate of the primary heat-releasing portion 61 was 0.2 or more.

As will be understood from the results of the aforementioned graphs, in the present invention, it is preferable to set the volume rate of the primary heat-releasing portion 61 with respect to the entire volume of the heat-releasing portions to be 0.2 (20%) to 0.5 (50%), more preferably 0.3 (30%) or less.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

INDUSTRIAL APPLICABILITY

The refrigeration system, the compressing and heat-releasing device and the heat-releasing device can be preferably used to, for example, car air-conditioners, household air-conditioners and coolers for electronics devices having a refrigeration cycle using a supercritical refrigerant such as $CO_2$.

The invention claimed is:

1. A refrigeration system, comprising:

a primary compressing portion that primarily compresses a refrigerant;

a secondary compressing portion that secondarily compresses the refrigerant;

a primary heat-releasing portion that primarily performs heat-releasing of the refrigerant;

a secondary heat-releasing portion that secondarily performs heat-releasing of the refrigerant;

a decompressing device that decompresses the refrigerant; and a cooling device that cools a medium to be cooled by absorbing heat from the medium, wherein the refrigerant primarily compressed by the primary compressing portion is primarily released in heat by the primary heat-releasing portion, the primarily heat-released refrigerant is secondarily compressed by the secondary compressing portion, the secondarily compressed refrigerant is secondarily released in heat by the secondary heat-releasing portion and then passes through the cooling device to absorb heat from the medium, and then returns to the primary compressing portion, wherein the refrigeration system is provided with a heat-releasing device, wherein a heat-releasing portion of the heat-releasing device is divided into two divisional heat-releasing portions, wherein one of the divisional heat-releasing portions constitutes the primary heat-releasing portion and the other thereof constitutes the secondary heat-releasing portion.

2. The refrigeration system as recited in claim 1, wherein the refrigeration system is provided with a multistage type compressing device, wherein a first-stage compressing portion of the multistage compressing device constitutes the primary compressing portion, and a second-stage compressing portion of the multistage compressing device constitutes the secondary compressing portion.

3. The refrigeration system as recited in claim 1, wherein a volume rate of the primary heat-releasing portion with respect to an entire volume of the heat-releasing portion of the heat-releasing device is set to be 0.2 to 0.5.

4. The refrigeration system as recited in claim 1, wherein a compression ratio of the refrigerant by the secondary compressing portion with respect to a compression ratio of the refrigerant by the primary compressing portion is set to be 0.5 to 1.5.

5. The refrigeration system as recited in claim 1, further comprising an intermediate heat exchanger for subcooling the refrigerant secondarily released in heat by the secondary heat-releasing portion by exchanging heat with a return traveling refrigerant flowing out of the cooling device.

6. The refrigeration system as recited in claim 1, wherein carbon dioxide ($CO_2$) is used as the refrigerant.

7. A compressing and heat-releasing apparatus equipped with a multistage compressor, wherein a refrigerant is primarily compressed by a first-stage compressing portion of the multistage compressor, the primarily compressed refrigerant is primarily released in heat by a primary heat-releasing portion, the primarily heat-released refrigerant is secondarily compressed by a second-stage compressing portion of the multistage compressor, the secondarily compressed refrigerant is secondarily released in heat by a secondary heat-releasing portion, to thereby obtain a low-temperature and high-pressure refrigerant, wherein the compressing and heat-releasing apparatus is provided with a heat-releasing device, wherein a heat-releasing portion of the heat-releasing device is divided into two divisional heat-releasing portions, and wherein one of the divisional heat-releasing portions constitutes the primary heat-releasing portion and the other thereof constitutes the secondary heat-releasing portion.

8. The compressing and heat-releasing apparatus as recited in claim 7, wherein a volume rate of the primary heat-releasing portion with respect to an entire volume of the heat-releasing portion of the heat-releasing device is set to be 0.2 to 0.5.

9. The compressing and heat-releasing apparatus as recited in claim 7, wherein a compression ratio of the refrigerant by the secondary compressing portion with respect to a compression ratio of the refrigerant by the primary compressing portion is set to be 0.5 to 1.5.

10. The compressing and heat-releasing apparatus as recited in claim 7, wherein carbon dioxide ($CO_2$) is used as the refrigerant.

11. A heat-releasing device provided with a primary heat-releasing portion for primarily releasing heat of a primarily compressed refrigerant and a secondary heat-releasing portion for secondary releasing heat of a secondarily compressed refrigerant after being primarily released in heat, the heat-releasing device comprising:

a pair of headers; and a plurality of heat exchanging tubes disposed between the pair of headers arranged in parallel with each other in a longitudinal direction of the header with opposite ends thereof being connected to the headers, wherein a refrigerant passing through the plurality of heat exchanging tubes exchanges heat with cooling air introduced from a front side of the heat-releasing device and passing through a gap between adjacent heat exchanging tubes to be released in heat, wherein each of the headers is divided by a partitioning member at a same height position to thereby classify the plurality of heat exchanging tubes into upper and lower heat exchanging tube groups, one of the heat exchanging tube group constituting the primary heat-releasing portion and the other thereof constituting the secondary heat-releasing portion.

12. The heat-releasing device as recited in claim 11, wherein the lower heat exchanging tube group constitutes the primary heat-releasing portion and the upper heat exchanging tube group constitutes the secondary heat-releasing portion.

13. The heat-releasing device as recited in claim 11, wherein an inner volume rate of the heat exchanging tubes constituting the primary heat-releasing portion with respect to an entire inner volume of the plurality of heat exchanging tubes is set to be 0.2 to 0.5.

14. The heat-releasing device as recited in claim 11, wherein carbon dioxide ($CO_2$) is used as the refrigerant.

15. A heat-releasing device provided with a primary heat-releasing portion for primarily releasing heat of a primarily compressed refrigerant and a secondary heat-releasing portion for secondarily releasing heat of a secondarily compressed refrigerant after being primarily released in heat, the heat-releasing device comprising:

a pair of headers; and a plurality of heat exchanging tubes disposed between the pair of headers arranged in parallel with each other in a longitudinal direction of the header with opposite ends thereof being connected to the headers, wherein a refrigerant passing through the plurality of heat exchanging tubes exchanges heat with cooling air introduced from a front side of the heat-releasing device and passing through a gap between adjacent heat exchanging tubes to be released in heat, wherein each of the heat exchanging tubes is provided with a plurality of refrigerant passages arranged in a tube widthwise direction, wherein each of the pair of headers is divided by a partitioning member extending in a longitudinal direction of the header into a front space and a rear space, whereby the plurality of refrigerant passages of each heat exchanging tube is classified into a front refrigerant passage group and a rear refrigerant passage group, one of the refrigerant passage groups constituting the primary heat-releasing portion and the other thereof constituting the secondary heat-releasing portion.

16. The heat-releasing device as recited in claim 15, wherein the rear refrigerant passage group constitutes the primary heat-releasing portion and the front refrigerant passage group constitutes the secondary heat-releasing portion.

17. The heat-releasing device as recited in claim 15, wherein an inner volume rate of the heat exchanging tubes constituting the primary heat-releasing portion with respect to an entire inner volume of the plurality of heat exchanging tubes is set to be 0.2 to 0.5.

18. The heat-releasing device as recited in claim 15, wherein carbon dioxide ($CO_2$) is used as the refrigerant.

19. The compressing and heat-releasing apparatus as recited in claim 10, wherein a compression ratio of the refrigerant by the secondary compressing portion with respect to a compression ratio of the refrigerant by the primary compressing portion is set to be 0.5 to 1.5.

20. The compressing and heat-releasing apparatus as recited in claim 8, wherein a compression ratio of the refrigerant by the secondary compressing portion with respect to a compression ratio of the refrigerant by the primary compressing portion is set to be 0.5 to 1.5.

* * * * *